US006594453B2

(12) United States Patent
Kato

(10) Patent No.: US 6,594,453 B2
(45) Date of Patent: Jul. 15, 2003

(54) IMAGE-FORMING DEVICE AND METHOD USING INFORMATION OBTAINED FOR A TONER-DENSITY REGULATION AND ALSO IN A POTENTIAL REGULATION WHEN THE TONER-DENSITY REGULATION IS NOT PERFORMED

(75) Inventor: Shinji Kato, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 99 days.

(21) Appl. No.: 09/968,798

(22) Filed: Oct. 3, 2001

(65) Prior Publication Data

US 2002/0044786 A1 Apr. 18, 2002

(30) Foreign Application Priority Data

Oct. 4, 2000 (JP) ..... 2000-305553

(51) Int. Cl.[7] ..... G03G 15/00
(52) U.S. Cl. ..... 399/49; 399/53
(58) Field of Search ..... 399/9, 46, 49, 399/50, 51, 53

(56) References Cited

U.S. PATENT DOCUMENTS 5,315,352 A * 5/1994 Nakane et al. ..... 399/49
5,327,196 A 7/1994 Kato et al. ..... 399/58
5,351,107 A * 9/1994 Nakane et al. ..... 399/49
5,365,313 A * 11/1994 Nagamochi et al. ..... 399/49
5,387,965 A 2/1995 Hasegawa et al. ..... 399/60
5,475,476 A 12/1995 Murai et al. ..... 399/29
5,682,572 A 10/1997 Murai et al. ..... 399/27
5,694,223 A * 12/1997 Katori et al. ..... 399/49 X
5,697,011 A * 12/1997 Kobayashi et al. ..... 399/49
5,822,079 A * 10/1998 Okuno et al. ..... 399/49 X
5,860,038 A 1/1999 Kato et al. ..... 399/49
6,055,386 A 4/2000 Kato et al. ..... 399/49

FOREIGN PATENT DOCUMENTS

JP 8-327331 * 12/1996

* cited by examiner

*Primary Examiner*—Fred L. Braun
(74) *Attorney, Agent, or Firm*—Oblon, Spivak, McClelland, Maier & Neustadt, P.C.

(57) ABSTRACT

In an image-forming device and method which includes an information-detecting device for detecting information A regarding a first processing condition and information B regarding a second processing condition, and a judging system for judging, according to the information A, whether or not a regulation of the first processing condition needs to be performed. When the judging system judges that the regulation of the first processing condition needs to be performed, a first regulation mode is performed in which the regulation of the first processing condition is performed, the information-detecting device detects at least the information B, and a regulation of the second processing condition is performed according to the information B. When the judging system judges otherwise, a second regulation mode is performed in which the first regulation mode is not performed, and the regulation of the second processing condition is performed according to the information B.

10 Claims, 9 Drawing Sheets

IMAGE-FORMING DEVICE AND METHOD USING INFORMATION OBTAINED FOR A TONER-DENSITY REGULATION AND ALSO IN A POTENTIAL REGULATION WHEN THE TONER-DENSITY REGULATION IS NOT PERFORMED

BACKGROUND OF THE INVENTION

1. Field of the Invention

The present invention generally relates to an image-forming device, such as a copying machine utilizing electrophotography, a facsimile, and a printer, and more particularly, to an image-forming device including process regulating means for regulating an image-forming electric potential formed on a latent image on an image-bearing member, and for regulating a toner density of a developer to form a toner image of the latent image, etc.

2. Description of the Related Art

In general, an image-forming device of this type comprises various types of image-forming means, such as a photosensitive member functioning as an image-bearing member, an electrifying device electrifying the photosensitive member, an exposing device forming a latent image on the electrified photosensitive member, a developing device developing the latent image on the photosensitive member so as to form a toner image on the photosensitive member, a transferring device transferring the toner image formed on the photosensitive member to a recording paper functioning as a recording medium, a cleaning device removing a residual toner on the photosensitive member after transferring, and a fixing device fixing the transferred toner image on the recording paper.

Further, in order to form an output image of a targeted quality, the image-forming device of this type conventionally performs various process regulations, such as an image-forming-potential regulation for regulating an image-forming electric potential of the latent image formed on the photosensitive member, and a toner-supplement regulation for adjusting a toner density of the developer used to form the toner image from the latent image.

The above-mentioned toner-supplement regulation is performed, for example, as follows.

First, as shown in FIG. 1 and FIG. 2, a plurality (three in the figures) of latent image patterns 20*a*, 20*b* and 20*c* at predetermined electric potentials are formed on a photosensitive member 20.

Next, an infrared light is projected from a toner-amount detecting sensor 25 to the photosensitive member 20 so as to detect the amount of toner attached on the latent image patterns 20*a*, 20*b* and 20*c*.

The toner-amount detecting sensor 25 comprises a light-emitting element 25*a* emitting the infrared light, and a light-receiving element 25*b* receiving a regular reflected light (a light beam having a reflection angle equal to an incident angle) of the infrared light, as shown in FIG. 2.

The toner-amount detecting sensor 25 detects whether or not the amount of the toner attached on the latent image patterns 20*a*, 20*b* and 20*c* is equal to a targeted amount of toner corresponding to a desired output image, on the basis of a luminous energy of the regular reflected light received by the light-receiving element 25*b*. When the luminous energy of the regular reflected light received by the light-receiving element 25*b* is large, i.e., when the amount of the toner attached on the latent image patterns 20*a*, 20*b* and 20*c* is insufficient, a toner supplement signal is output from the light-receiving element 25*b*.

Then, when the toner supplement signal is output from the light-receiving element 25*b*, a proper amount of toner is supplemented from a toner-supplementing device (not shown in the figures) to the above-mentioned developing device. Thereby, the toner density of the developer supplied from the developing device is made appropriate so that the amount of the attached toner of the toner image formed on the photosensitive member 20 becomes an amount that can achieve a targeted quality of the desired output image.

On the other hand, the above-mentioned image-forming-potential regulation is performed, for example, as follows.

First, as shown in FIG. 3, a plurality (three in the figure) of patterned latent images at electric potentials different from one another by increasing degrees are formed on the photosensitive member 20, and are developed by using a toner so that latent image patterns 30*a*, 30*b* and 30*c* having different toner densities are formed on the photosensitive member 20.

Next, a development characteristic (a development $\gamma$) of the above-mentioned developing device is calculated from the relationship between the amount of toner attached on the latent image patterns 30*a*, 30*b* and 30*c* and the surface potential of the latent image patterns 30*a*, 30*b* and 30*c* detected by a potential sensor (not shown in the figure). A grid voltage of the above-mentioned electrifying device, a development bias of the above-mentioned developing device, and an LD (a laser luminescence) power of the above-mentioned exposing device, etc. are regulated so that the amount of the toner attached on the latent image patterns 30*a*, 30*b* and 30*c* becomes equal to a targeted amount of toner. Thereby, the electric potential to form the toner image on the photosensitive member 20 is optimized so that the amount of the attached toner of the toner image becomes an amount that can achieve a targeted quality of a desired output image.

Thus, it is supposed that, in the image-forming device of this type, if the toner density of the developer supplied from the developing device and the electric potential to form the toner image on the photosensitive member 20 are optimized by the above-described toner-supplement regulation and the image-forming-potential regulation, the amount of the attached toner of the toner image is maintained in an ideal condition that can achieve the targeted quality of the desired output image.

In reality, however, the image-forming device of this type performs an image formation in various cases as follows: the toner image is formed only by a developer of a particular color; an image area is extremely small; a normal image formation is hardly performed, and therefore, only an automatic regulation is performed in which the toner supplementation by the above-mentioned image-forming-potential regulation, etc. is not performed. At this point, normally in the above-mentioned toner-supplement regulation, when the toner image is not formed on the photosensitive member 20, no toner is supplemented from the above-mentioned toner-supplementing device to the above-mentioned developing device. Therefore, when the development capability (a capability of developing the latent image) of the developing device is either higher or lower than a standard level, there occurs a problem that the image-forming potential-regulation alone cannot sufficiently regulate the amount of the attached toner of the toner image.

In order to solve this problem, there is a conventional image-forming device performing a so-called self-check, in which a toner is supplemented to the above-mentioned developing device; or a toner is consumed in the developing device, at a predetermined timing, so as to adjust the toner density of the developer supplied from the developing device, and thereafter, the above-mentioned image-forming-potential regulation is performed.

The image-forming-potential regulation in this image-forming device is performed as a special job at a timing different from an image-forming routine of a normal toner image. For example, the image-forming-potential regulation is performed, for example, immediately after electric power is supplied to the image-forming device having the above-mentioned fixing device in a cool state, after an image-forming job is performed predetermined times, or after a predetermined time has passed since the previous image-forming-potential regulation.

The special job for the self-check as mentioned above is effective in maintaining an image quality. Especially, in a color-image forming device, the process regulations are made more stable by performing various regulations, as described above, based on plenty of information in a sufficient period of time for each color.

However, in an image-forming device structured so as to perform the special job for the self-check as mentioned above, various regulations are performed in the special job, based on plenty of information in a sufficient period of time for each color. This results in a problem that a user cannot use this image-forming device to conduct an image-formation during a predetermined time in which the regulations are performed.

Conventionally, in consideration of such an operability for the user, the special job is performed using a period of time in which the fixing device warms up upon supplying electric power to the image-forming device for the day. However, a recent image-forming device is required to have a shortened start-up time; therefore, it is difficult to secure a sufficient period of time to perform the special job.

Additionally, an image-forming device installed in a convenience store, for example, is frequently used while electric power is kept supplied 24 hours a day. With respect to this image-forming device, there is a problem that a user has no time or place to wait for the special job to be performed.

SUMMARY OF THE INVENTION

It is a general object of the present invention to provide an improved and useful image-forming device in which the above-mentioned problems are eliminated.

A more specific object of the present invention is to provide an image-forming device which can perform a self-check in a shortened period of time while maintaining a targeted image quality.

In order to achieve the above-mentioned objects, there is provided according to one aspect of the present invention an image-forming device comprising:

information-detecting means for detecting information A regarding first processing means and information B regarding second processing means; and judging means for judging, according to the information A, whether or not a regulation of the first processing means needs to be performed, wherein, when the judging means judges that the regulation of the first processing means needs to be performed, a first regulation mode is performed in which the regulation of the first processing means is performed, the information-detecting means detects at least the information B, and a regulation of the second processing means is performed according to the information B, and when the judging means judges that the regulation of the first processing means does not need to be performed, a second regulation mode is performed in which the first regulation mode is not performed, and the regulation of the second processing means is performed according to the information B.

In the image-forming device according to the present invention, when the judging means judges that the regulation of the first processing means does not need to be performed, the regulation of the first processing means is not performed, and the information-detecting means does not detect the information B once again. Accordingly, the image-forming device according to the present invention can perform the process regulations as above in a shortened period of time when the judging means judges that the regulation of the first processing means does not need to be performed.

Additionally, in the image-forming device according to the present invention, the information A may regard a toner-density regulation regulating a toner density of-developing means functioning as the first processing means, and the information B may regard at least one of an electrification potential of electrifying means, a write luminous energy of image-writing means, and a developing bias of the developing means, the electrifying means, the image-writing means, and the developing means functioning as the second processing means.

Additionally, in the image-forming device according to the present invention, the developing means may comprise a plurality of developing devices respectively containing toners of a plurality of colors.

In the image-forming device according to the present invention, when the judging means judges that the toner-density regulation of the developing means does not need to be performed, the toner-density regulation of the developing means is not performed, and the information-detecting means does not detect the information B once again. Accordingly, the image-forming device according to the present invention can perform the process regulations as above in a shortened period of time when the judging means judges that the toner-density regulation of the developing means does not need to be performed.

In order to achieve the above-mentioned objects, there is also provided according to another aspect of the present invention an image-forming device comprising:

information-detecting means for detecting information A regarding a toner-density regulation of a plurality of developing devices and information B regarding at least one of an electrification potential of electrifying means, a write luminous energy of image-writing means, and a developing bias of each of the developing devices; and judging means for judging, according to the information A, whether or not the toner-density regulation of each of the developing devices needs to be performed, wherein, when the judging means judges that the toner-density regulation of one of the developing devices needs to be performed, a first regulation mode is performed in which the toner-density regulation of the one of the developing devices is performed, the information-detecting means again detects at least the information B with respect to the one of the developing devices, and a regulation of at least one of the electrification potential of the electrifying means, the write luminous energy of the image-writing means, and the developing bias of the one of the developing devices is performed according to the information B, and when the judging means judges that the toner-density regulation of one of the developing devices does not need to be performed, a second regulation mode is performed in which the first regulation mode is not performed with respect to the one of the developing devices, and the regulation of at least one of the electrification potential of the electrifying means, the write luminous energy of the image-writing means, and the developing bias of the one of the developing devices is performed according to the information B.

In the image-forming device according to the present invention, when the judging means judges that the toner-density regulation of a particular one of the developing devices does not need to be performed, the first regulation mode is not performed with respect to the particular developing device. In other words, when the judging means judges that the toner-density regulation of a particular one of the developing devices needs to be performed, the first regulation mode is performed with respect to the particular developing device. Thereby, even when the judging means judges that the toner-density regulation does not need to be performed for the first developing device, for example, the judging means surely judges whether to perform the toner-density regulation with respect to the other developing devices without erroneously skipping those judgments and proceeding to the process regulations. Besides, when it is arranged that the information-detecting means detects the information by sensing latent image patterns formed on an image-bearing member, the latent image patterns do not need to be re-formed to sense the latent image patterns again, when the judging means judges that the toner-density regulation of the particular developing device does not need to be performed. This prevents the toner from being wastefully consumed.

Additionally, in the image-forming device according to the present invention, each of the developing devices may be moved to a predetermined position so as to perform an image-development, and the judging means may judge, according to the information A, whether or not the toner-density regulation of each of the developing devices moved to the predetermined position needs to be performed, and successively, when the judging means judges that the toner-density regulation of one of the developing devices moved to the predetermined position needs to be performed, the toner-density regulation of the one of the developing devices may be performed.

In the image-forming device according to the present invention, the judging operation and the toner density regulation are performed in succession when the judging means judges that the toner-density regulation needs to be performed with respect to one of the developing devices moved to the predetermined position. Thereby, the developing devices do not have to be moved to the development position between the judging operation and the toner density regulation. This minimizes a time required for shifting the developing devices to the development position. Thus, the image-forming device according to the present invention can perform the process regulations as above in a shortened period of time.

Other objects, features and advantages of the present invention will become more apparent from the following detailed description when read in conjunction with the accompanying drawings.

DETAILED DESCRIPTION OF THE PREFERRED EMBODIMENTS

Figure 1:
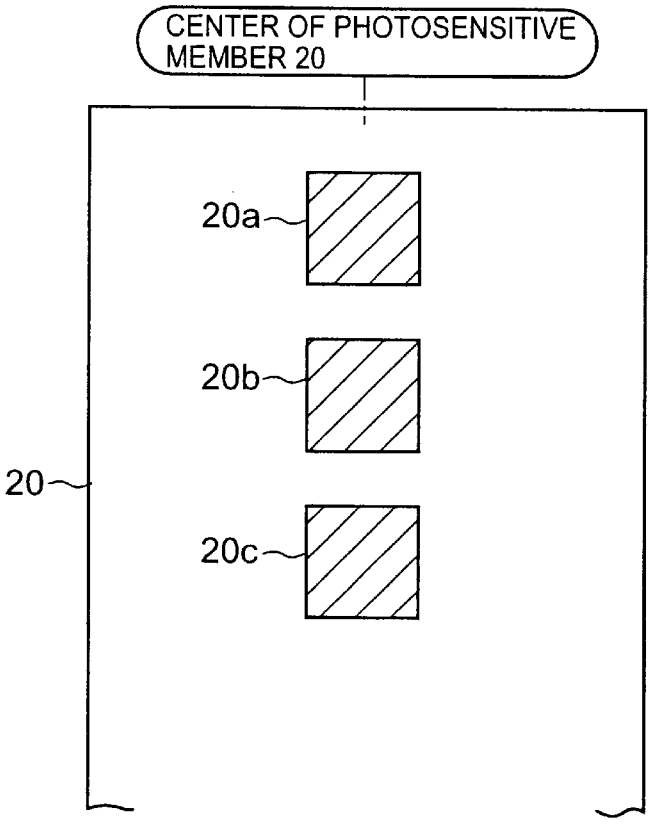
FIG.1 PRIOR ART
FIG. 1 outlines toner patterns formed in a toner-supplement regulation or in a toner-consumption regulation performed in an image-forming device.
Figure 2:
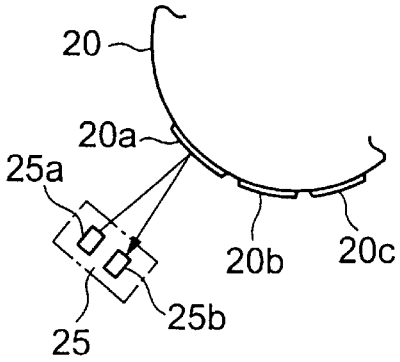
FIG.2 PRIOR ART
FIG. 2 is an illustration used for explaining an operation of detecting latent image patterns formed on an image-bearing member in the image-forming device.
Figure 3:
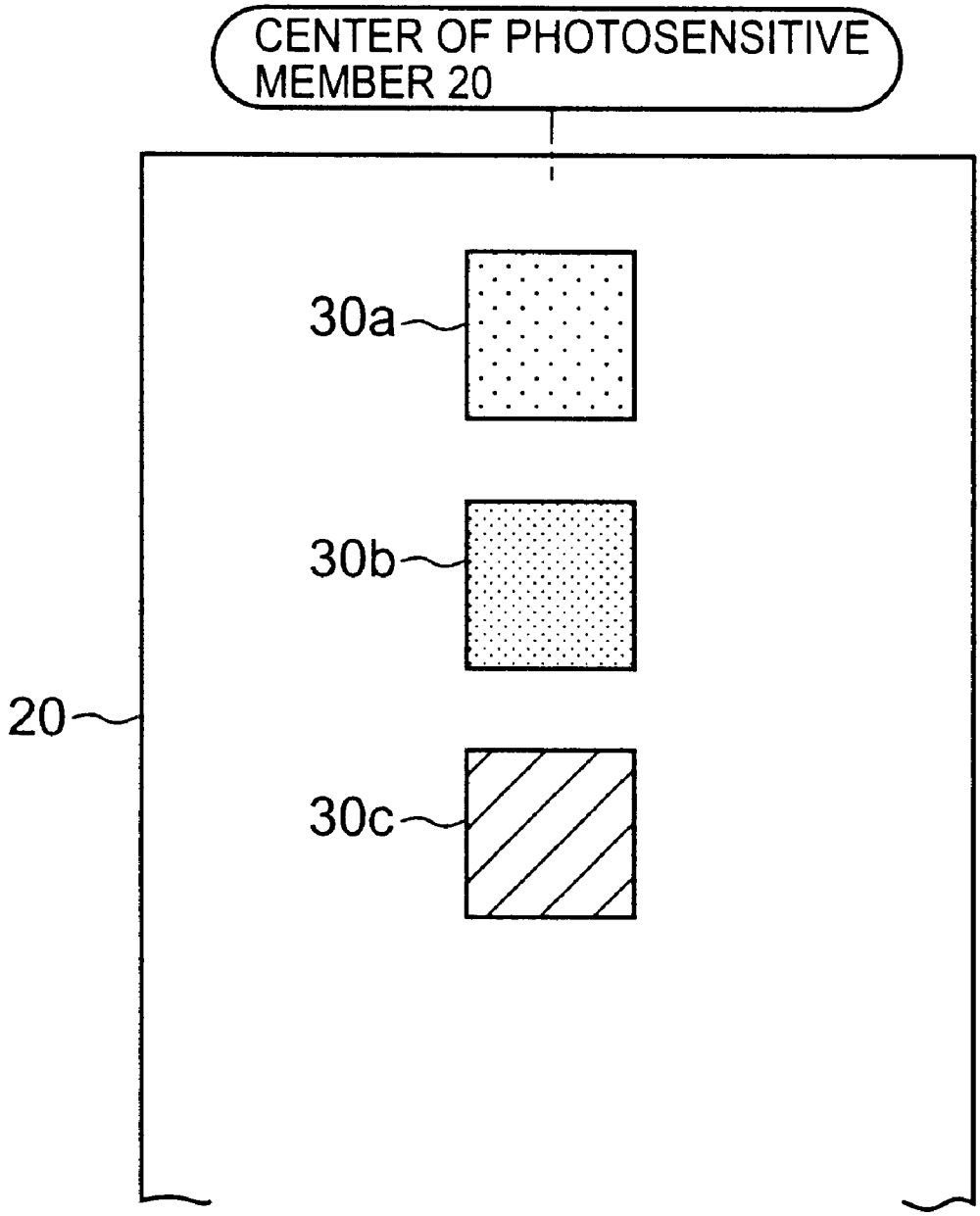
FIG.3 PRIOR ART
FIG. 3 outlines toner patterns formed in an image-forming-potential regulation performed in the image-forming device.
Figure 4:
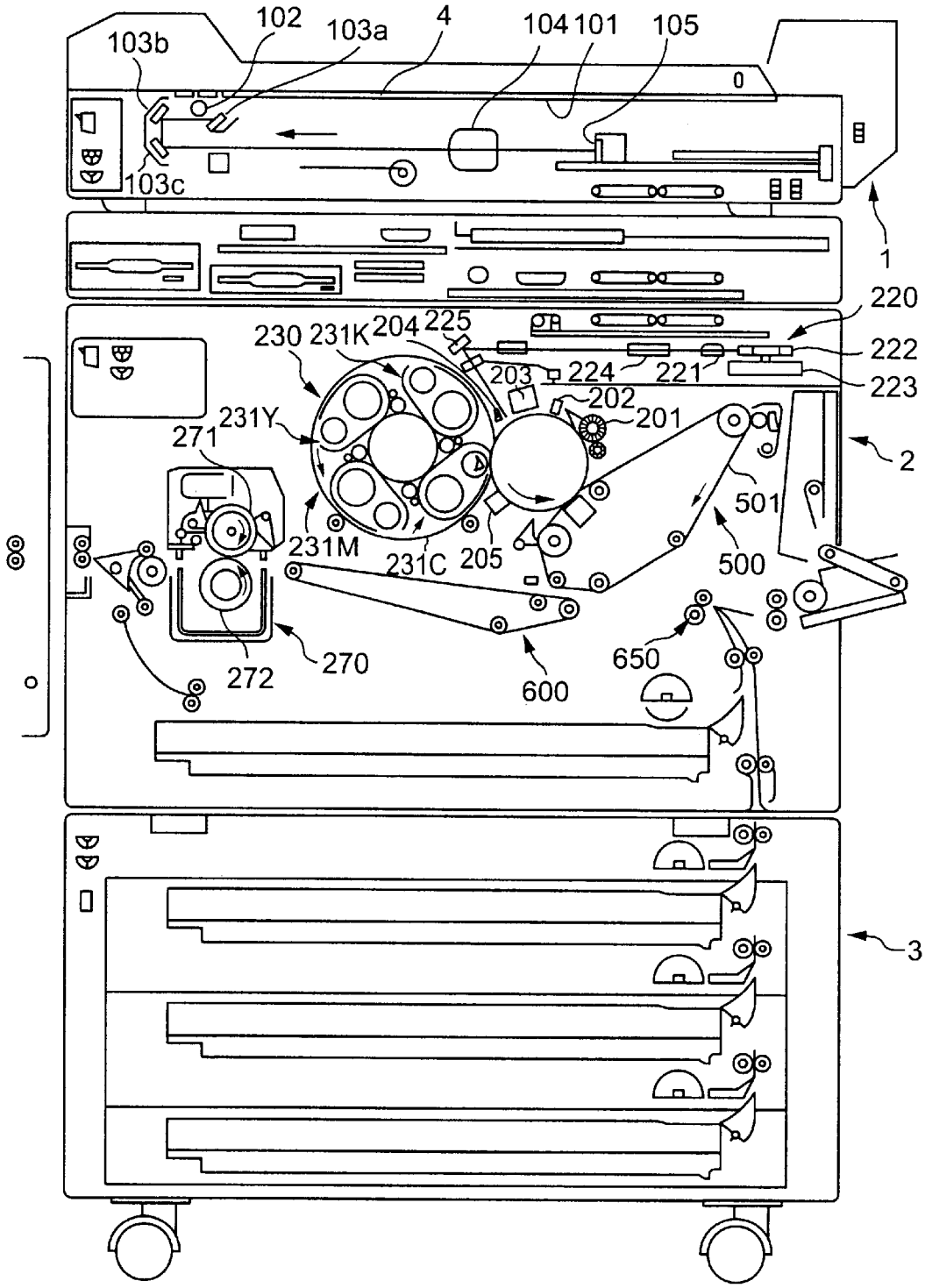
FIG. 4 is an illustration outlining a structure of an image-forming device according to a first embodiment of the present invention.

A description will now be given of embodiments according to the present invention. FIG. 4 is an illustration outlining a structure of an image-forming device according to a first embodiment of the present invention. The image-forming device according to the present embodiment is a color-copying machine using electrophotography (hereinafter referred to as a color-copying machine). First, a description will be given, with reference to FIG. 4, of the structure and operations of the color-copying machine according to the present embodiment. This color-copying machine comprises a color-image reading device (hereinafter referred to as a color scanner) 1, a color-image recording device (hereinafter referred to as a color printer) 2, a sheet-feeding bank 3, and other components, as shown in FIG. 4.

The color scanner 1 forms an image of a subject copy 4 placed on a contact glass 101 onto a color sensor 105 via an illuminating lamp 102, a group of mirrors 103*a*, 103*b* and

103*c*, and a lens 104 so as to read color image information of the subject copy 4 for each of color separation lights of red, green and blue (hereinafter referred to as R, G and B), for example, and convert the color image information into electrical image signals. Alternatively, image data of R, G and B is stored in a (RGB) memory. When using the memory (not shown in the figure), the image data of the three colors (R, G and B) is obtained by one instance of scanning. The color sensor 105 comprises an RGB color-separating means and a photoelectric convert element, such as a CCD, and reads the three separated color images of the image of the subject copy 4 at the same time.

Then, based on intensity levels of the color-separation image signals of R, G and B obtained in the color scanner 1, a color converting process is performed in an image processing unit (not shown in the figure) so as to obtain color image data of black (hereinafter referred to as Bk), cyan (hereinafter referred to as C), magenta (hereinafter referred to as M), and yellow (hereinafter referred to as Y). The color image data is developed, color by color, into respective images by the color printer 2, and the images are eventually overlapped so as to form a full-four-colored image.

An operation of the color scanner 1 to obtain the above-mentioned color image data of Bk, C, M and Y is as follows. In response to a scanner-start signal timed with a hereinafter-described operation of the color printer 2, an optical system formed by the illuminating lamp 102 and the group of the mirrors 103*a*, 103*b* and 103*c* scans the subject copy 4 to the left, as indicated by an arrow in FIG. 4, so as to obtain color image data of one color each time. By repeating this operation four times, the color image data of the four colors is obtained. The color image data is developed each time, color by color, into respective images by the color printer 2, and the images are eventually overlapped so as to form a full-four-colored image.

Figure 5:
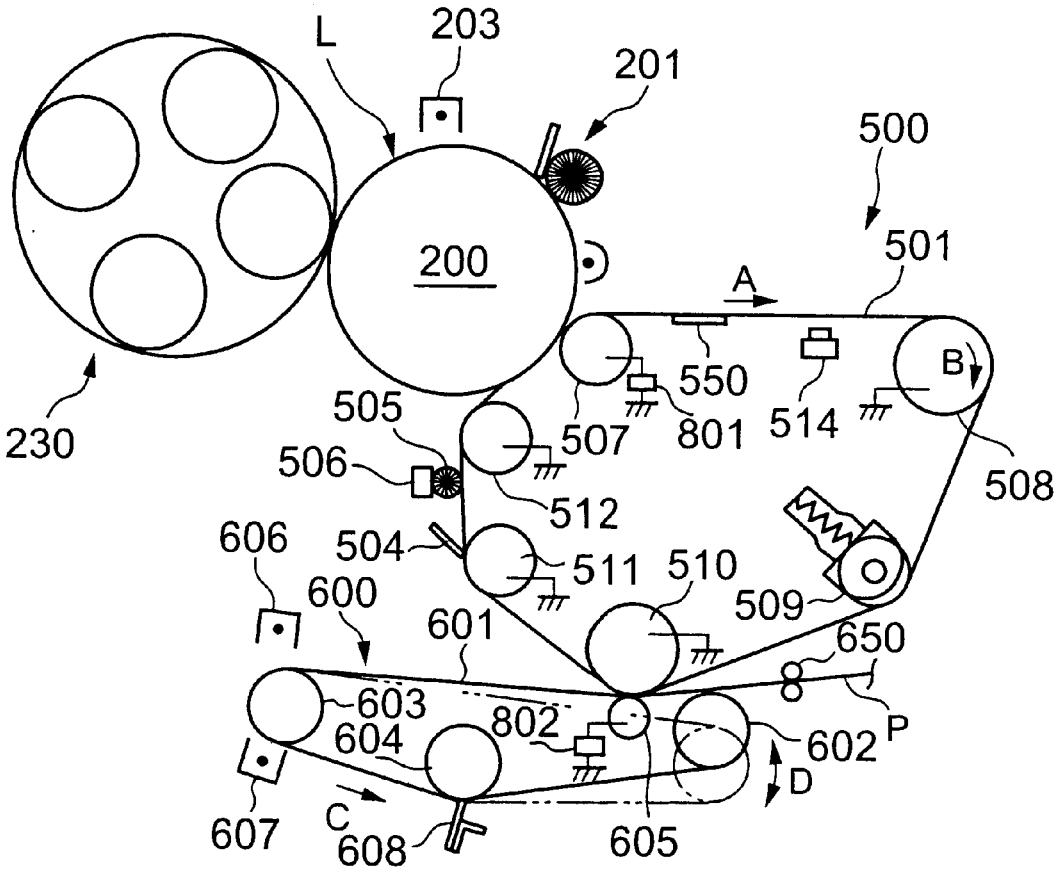
FIG. 5 is a magnified view of an image-forming unit of the image-forming device shown in FIG. 4.

FIG. 5 is a magnified view of an image-forming unit of the image-forming device (the color-copying machine) according to the present embodiment. As shown in FIG. 4 and FIG. 5, the color printer 2 comprises a photosensitive drum 200 as an image-bearing member, a write optical unit 220, a revolver development unit 230, an intermediate transferring unit 500, a secondary transferring unit 600, a fixing device 270, and other components.

The photosensitive drum 200 revolves counterclockwise as indicated by a curved arrow in FIG. 4. Around the photosensitive drum 200 are arranged a photosensitive-drum cleaning device 201, an electricity-removal lamp 202, an electrifying device 203, a surface-potential sensor 204, a selected developing device of the revolver development unit 230, a reflection-density sensor 205, the intermediate transferring unit 500, the secondary transferring unit 600, and other components.

The write optical unit 220 converts the color image data transferred from the color scanner 1 into an optical signal, and performs an optical writing corresponding to the image of the subject copy 4 so as to form an electrostatic latent image on the photosensitive drum 200. This write optical unit 220 comprises a semiconductor laser 221 as a light source, a laser-luminescence drive regulation unit (not shown in the figure), a polygon mirror 222, a motor 223 for revolving the polygon mirror 222, a f/θ lens 224, a reflective mirror 225, and other components.

The revolver development unit 230 comprises a Bk developing device 231K, a C developing device 231C, an M developing device 231M, a Y developing device 231Y, a hereinafter-described revolver driving unit revolving the developing devices 231K, 231C, 231M and 231Y counterclockwise as indicated by a curved arrow in FIG. 4, and other components. Each of the developing devices 231K, 231C, 231M and 231Y comprises a developing sleeve developing the electrostatic latent image by revolving so as to bring a crest of a developer into contact with the surface of the photosensitive drum 200, a developer paddle revolving so as to scoop up and sir the developer, and other components.

A toner in each of the developing devices 231K, 231C, 231M and 231Y is negatively electrified by being agitated with a ferrite carrier. A development bias in which an alternating-current voltage Vac is superimposed on a negative direct-current voltage Vdc is applied to each of the developing sleeves by a development-bias power source (not shown in the figures) so that the developing sleeve is biased at a predetermined electric potential with respect to a metallic substratum of the photosensitive drum 200.

In a stand-by state of the color-copying machine, the Bk developing device 231K of the revolver development unit 230 is set 45 degrees before a development position. Upon the start of a copying operation, the color image data of Bk starts being read at a predetermined point of time by the color scanner 1. Based on this color image data, the optical writing and a formation of an electrostatic latent image are started by using a laser beam. (Hereinafter, the electrostatic latent image based on the color image data of Bk is referred to as a Bk electrostatic latent image; ditto for C, M and Y.)

Before the front end of the Bk electrostatic latent image reaches a Bk development position, the Bk developing device 231K is moved to the development position. Then, the Bk developing sleeve starts being revolved so as to develop the Bk electrostatic latent image by using a Bk toner. This operation of developing the Bk electrostatic latent image area is continued until the tail end of the Bk electrostatic latent image passes the Bk development position and runs a predetermined distance thence. Subsequently, the revolver development unit 230 revolves until the developing device of the next color (231C) reaches the development position. This revolution is completed at least before the front end of the electrostatic latent image based on the next color image data reaches the development position.

The intermediate transferring unit 500 comprises an intermediate transferring belt 501 functioning as an intermediate transferring member stretched along a plurality of rollers described hereinafter, and other components. Around this intermediate transferring belt 501 are arranged a secondary transferring belt 601 which is a transfer material bearing member of the secondary transferring unit 600, a secondary transferring bias roller 605 which is a secondary-transfer charging means, a belt-cleaning blade 504 functioning as a means for cleaning the intermediate transferring member (the intermediate transferring belt 501), a lubricant-applying brush 505 which is a lubricant-applying means, and other components, such that these components face the intermediate transferring belt 501.

Position detection marks are provided on the outer or inner surface of the intermediate transferring belt 501. Specifically, when the position detection marks are provided on the outer surface of the intermediate transferring belt 501, the position detection marks need to be provided so as to avoid a cleaning range of the belt-cleaning blade 504. In cases where this necessitates a difficult contrivance, the position detection marks are provided on the inner surface of the intermediate transferring belt 501. An optical sensor 514 functioning as a mark-detecting sensor is provided between a first transferring bias roller 507 and a belt-driving roller 508 over which the intermediate transferring belt 501 is stretched.

The intermediate transferring belt 501 is stretched along the first transferring bias roller 507, the belt-driving roller 508, a belt-tension roller 509, a secondary-transferring-unit facing roller 510, a cleaning-blade facing roller 511, and a grounding roller 512. Each of the rollers 507 to 512 is formed of a conductive material. Each of the rollers 508 to 512, except the first transferring bias roller 507, are grounded.

A transfer bias regulated at a predetermined magnitude of electric current or voltage corresponding to the number of overlapped toner images is applied to the first transferring bias roller 507 by a first transfer power source 801 subjected to a constant-current or constant-voltage regulation. The intermediate transferring belt 501 is driven in a direction indicated by an arrow A in FIG. 5 by the belt-driving roller 508 being revolved in a direction indicated by an arrow B by a driving motor (not shown in the figures).

This intermediate transferring belt 501 is a semiconductor or an insulator having a single-layered or multilayered structure. The intermediate transferring belt 501 is formed larger than the maximum size for a sheet to pass through so as to overlap the toner images on the photosensitive drum 200.

In a transferring part transferring the toner images formed on the photosensitive drum 200 to the intermediate transferring belt 501 (hereinafter referred to as a first transferring part), the first transferring bias roller 507 and the grounding roller 512 press the intermediate transferring belt 501 against the photosensitive drum 200 so as to form a nip part having a predetermined width between the photosensitive drum 200 and the intermediate transferring belt 501.

The lubricant-applying brush 505 grinds a zinc stearate 506, which is a plate-shaped lubricant, into fine particles, and applies the fine particles to the intermediate transferring belt 501. This lubricant-applying brush 505 is arranged so as not to continuously contact the intermediate transferring belt 501, but to contact the intermediate transferring belt 501 according to a predetermined timing.

The secondary transferring unit 600 comprises three supporting rollers 602, 603 and 604, the secondary transferring belt 601 stretched along these three supporting rollers 602, 603 and 604, and other components. A stretched part of the secondary transferring belt 601 between the supporting rollers 602 and 603 can be pressed into contact with the secondary-transferring-unit facing roller 510. One of the three supporting rollers 602, 603 and 604 is a driving roller revolved by a driver (not shown in the figures). The secondary transferring belt 601 is driven in a direction indicated by an arrow C in FIG. 5 by the driving roller.

The above-mentioned secondary transferring bias roller 605 is a secondary transferring means, and is arranged so that the secondary transferring bias roller 605 and the secondary-transferring-unit facing roller 510 hold the intermediate transferring belt 501 and the secondary transferring belt 601 therebetween. A transfer bias of a predetermined electric current is applied to the secondary transferring bias roller 605 by a secondary transfer power source 802 subjected to a constant-current regulation. In addition, a depart/contact mechanism (not shown in the figures) driving the supporting roller 602 and the secondary transferring bias roller 605 in directions indicated by an double-pointed arrow D in FIG. 5 is provided so that the secondary transferring belt 601 and the secondary transferring bias roller 605 can be pressed into contact with the secondary-transferring-unit facing roller 510 and can be departed therefrom. Double dashed chain lines shown in FIG. 5 indicate the secondary transferring belt 601 and the supporting roller 602 in the state where the secondary transferring belt 601 and the secondary transferring bias roller 605 are departed from the secondary-transferring-unit facing roller 510.

A pair of register rollers 650 feed a transfer paper P, which is a transfer material, between the intermediate transferring belt 501 and the secondary transferring belt 601 held between the secondary transferring bias roller 605 and the secondary-transferring-unit facing roller 510 according to a predetermined timing.

A transfer-paper discharger 606 functioning as a transfer-material discharging means and a belt discharger 607 functioning as a transfer-material-bearing-member discharging means oppose each other with a part of the secondary transferring belt 601 stretched along the supporting roller 603 therebetween. A cleaning blade 608 functioning as a transfer-material-bearing-member cleaning means contacts a part of the secondary transferring belt 601 stretched on the supporting roller 604.

The transfer-paper discharger 606 removes a charge held by the transfer paper so that the transfer paper can preferably separate itself from the secondary transferring belt 601 due to its own strength. The belt discharger 607 removes a charge remaining on the secondary transferring belt 601. The cleaning blade 608 cleans the surface of the secondary transferring belt 601 by removing unnecessary materials attached thereon.

When a repeat-image-forming cycle of A4 cross-feeding is started in the color-copying machine structured as above, the photosensitive drum 200 and the intermediate transferring belt 501 are revolved by driving motors (not shown in the figures) counterclockwise and clockwise, respectively, as indicated by the arrows shown in FIG. 4, at a same velocity in the first transferring part as a first transferring means. A mark (MC) is provided on the inner surface of the intermediate transferring belt 501. This mark (MC) moves together with the intermediate transferring belt 501. The optical sensor 514 is mounted on a fixed member in a predetermined passing range of the mark (MC).

A reflective photo sensor or a transmission photo sensor is used as this optical sensor 514. When the reflective photo sensor is used as the optical sensor 514, such a material as a reflective tape is applied as the mark (MC) on the intermediate transferring belt 501, and the reflective photo sensor reads a part transiting from a less reflective part to the mark (MC) on the intermediate transferring belt 501, or reads a part transiting from the mark (MC) to a less reflective part on the intermediate transferring belt 501.

A two-screen formation of the Bk toner image, a two-screen formation of the Y toner image, a two-screen formation of the C toner image, and a two-screen formation of the M toner image are subjected to the first transfer by the transfer bias of the voltage applied to the first transferring bias roller 507, and eventually, the toner images are overlapped in the order of Bk, Y, C, M so as to form two screens of the toner images.

For example, the Bk toner image is formed as follows. The electrifying device 203 electrifies the surface of the photosensitive drum 200 uniformly at a predetermined potential with a negative charge by performing a corona discharge. After a predetermined time has passed since the optical sensor 514 detects the mark (MC), the optical writing is performed as follows. The write optical unit 220 converts the image data stored in the RGB memory into a color image signal. Based on this color image signal, the Bk data is subjected to a raster-exposing by a laser beam. When this raster image is exposed, the exposed part on the surface of the photosensitive drum 200 initially electrified uniformly loses a charge in proportion to the applied luminous energy so as to form the Bk electrostatic latent image.

The Bk toner electrified negatively on a Bk developing roller of the Bk developing device 231K contacts this Bk electrostatic latent image. The toner does not adhere to a remnant charged part on the surface of the photosensitive drum 200, but adheres to the non-charged part, i.e., the exposed part on the surface of the photosensitive drum 200 so as to form the Bk toner image similar to the Bk electrostatic latent image. This Bk toner image formed on the photosensitive drum 200 is transferred to the surface of the intermediate transferring belt 501 being revolved at the same velocity as the photosensitive drum 200 while in contact therewith. Hereinafter, the transfer of the toner image from the photosensitive drum 200 to the intermediate transferring belt 501 is referred to as a "belt transfer".

A slight amount of the residual toner remaining on the surface of the photosensitive drum 200 after the above-mentioned belt transfer is cleaned by the photosensitive-drum cleaning device 201 in preparation for the next use of the photosensitive drum 200.

On the photosensitive drum 200, a C-image forming step starts after the Bk-image forming step, upon which the image data of C starts being read by the color scanner 1 according to a predetermined timing. The C electrostatic latent image is formed on the surface of the photosensitive drum 200 by a laser optical writing based on the image data of C.

Then, after the tail end of the Bk electrostatic latent image passes the development position and runs a predetermined distance thence, and before the front end of the C electrostatic latent image reaches the development position, the revolver development unit 230 revolves so as to set the C developing device 231C at the development position. Then, the C electrostatic latent image is developed by using a C toner.

This operation of developing the C electrostatic latent image area is continued until the tail end of the C electrostatic latent image passes the development position and runs a predetermined distance thence. Subsequently, as in the above case of the Bk developing device, the revolver development unit 230 revolves until the next M developing device 231M reaches the development position. This revolution is completed at least before the front end of the M electrostatic latent image reaches the development position.

Steps of forming the M and Y images include the same operations of reading the respective color image data, forming the electrostatic latent image, and developing the electrostatic latent image as the above-described Bk and C image forming steps, therefore will not be described in detail.

The toner images of Bk, C, M and Y formed one by one on the photosensitive drum 200 are transferred one by one at a same position on the intermediate transferring belt 501. This forms a toner image on the intermediate transferring belt 501 by overlapping the four-color toner images at the maximum.

Upon starting the above-described image-forming cycle, the transfer paper P is fed from a paper feeding unit, such as a transfer-paper cassette (not shown in the figures) or a manual-feeding tray, to a nip part of the pair of the register rollers 650, and stands by thereat. The transfer-paper cassette can carry a transfer paper of a normally used size, such as an A3 paper used in Japan and Europe, and a DLT (double-letter size) paper used in North America. The manual-feeding tray can further carry an extended A3 paper, which is longer than the A3 paper, an indeterminate form, a thick paper, etc.

When the front end of the toner image formed on the intermediate transferring belt 501 reaches a secondary transferring part in which a nip part is formed by the secondary-transferring-unit facing roller 510 and the secondary transferring bias roller 605, the pair of the register rollers 650 is driven so that the front end of the transfer paper P coincides with the front end of the toner image. This registers the transfer paper P and the toner image.

Then, the transfer paper P passes the secondary transferring part so as to be overlapped with the toner image formed on the intermediate transferring belt 501. Thereupon, the four-color toner image on the intermediate transferring belt 501 is transferred to the transfer paper P all at once by the transfer bias of the voltage applied to the secondary transferring bias roller 605 by the secondary transfer power source 802.

Thereafter, when the transfer paper P passes a part facing the transfer-paper discharger 606 placed downstream in the moving direction of the secondary transferring belt 601, the transfer paper P is discharged so as to be separated from the secondary transferring belt 601, and then is sent to an upper fixing roller 271 and a lower fixing roller 272.

The toner image is fixed on the transfer paper P by being fused at a nip portion of the upper fixing roller 271 and the lower fixing roller 272. Then, the transfer paper P is sent out of the body of the color-copying machine by a pair of delivering rollers (not shown in the figures), and is stacked on a copy tray (not shown in the figures) with the front of the transfer paper facing upward; thereby, a full color copy is obtained.

On the other hand, the surface of the photosensitive drum 200 after the above-mentioned transfer is cleaned by the photosensitive-drum cleaning device 201, and is uniformly discharged by the electricity-removal lamp 202.

In addition, the residual toner remaining on the surface of the intermediate transferring belt 501 after the toner is transferred to the transfer paper P is cleaned by the belt-cleaning blade 504 being pressed thereagainst by a depart/contact mechanism (not shown in the figures).

At this point, in a case of a repeat copying, with respect to the operation of the color scanner 1 and the image-formation on the photosensitive drum 200, an image forming step of the first color (Bk) for the third screen is performed after the image forming step of the fourth color (Y) for the second screen, according to a predetermined timing. With respect to the intermediate transferring belt 501, after the step of transferring the four-color toner image for the first and second papers all at once, the Bk toner image for the third paper is transferred to a region on the surface of the intermediate transferring belt 501 cleaned by the belt-cleaning blade 504. Thereafter, the same operations as for the first and second papers are performed.

Above described is a copy mode obtaining a full-four-colored copy. In cases of a three-color copy mode or a two-color copy mode, the same operations as above are repeated predetermined times for specified colors.

In a case of a monochrome mode, the developing device of only a predetermined color of the revolver development unit 230 is put in the developing operation, and the belt-cleaning blade 504 is kept pressed against the intermediate transferring belt 501 until a predetermined number of subject copies are copied to the transfer papers.

Next, a description will be given of a self-check in the color-copying machine according to the present embodiment.

Specifically, a description will be given, with reference to FIG. 6, of a self-check routine performed by a main regulating unit (not shown in the figures) in the color-copying machine according to the present embodiment.

This self-check routine is performed basically upon the start of the color-copying machine, and after a predetermined number of papers are copied, or at predetermined intervals, case by case (STEP1). In this description, the execution of the self-check routine upon the start of the color-copying machine will be described.

First, in order to distinguish a state upon turning on the power from an abnormal processing state such as a jamming, it is judged whether or not the fixing temperature of the fixing device 270 exceeds 100° C. according to a signal supplied from a fixing temperature sensor of the fixing device 270, prior to performing the self-check routine. When the fixing temperature of the fixing device 270 exceeds 100° C., it is judged that the state is abnormal so as not to perform a potential regulation described hereinbelow.

Hereinbelow, a description will be given of the potential regulation of regulating an electric potential of the latent image formed on the photosensitive drum 200. When the fixing temperature of the fixing device 270 does not exceed 100° C., the main regulating unit (not shown in the figures) checks the surface potential by using the surface-potential sensor 204 in STEP2. When the surface potential is not within a predetermined range, the main regulation unit informs the system of the abnormality.

Next, in STEP3 of Vsg adjustment, the main regulating unit obtains an output value of the reflection-density sensor 205 to the surface of the photosensitive drum 200, and adjusts the luminance of the reflection-density sensor 205 so that the reflected light projected from the reflection-density sensor 205 to the surface of the photosensitive drum 200 becomes a constant amount.

In normal cases, a potential regulation is performed only by changing an image-forming potential. However, when the development capability of the developing device 231 falls lower than a predetermined level, the image density cannot be increased only by the image-forming potential. On the other hand, when the development capability increases higher than a predetermined level, there may occur problems, such as a defective gradation, a toner dispersion, a toner fixation to the developing sleeve. It is difficult or impossible to prevent these problems directly only by the image-forming potential. Essentially, it is necessary to regulate the toner density in an optimal state in a short period of time.

Thereupon, a description will be given of a toner-supplement mode, and a toner-consumption mode to adjust the toner density. First, in STEP4 in FIG. 6, the developing device of a development-capability detection color is moved to the development position. Firstly, the developing device 231K of Bk as the detection color is moved to the development position, and after a judgment in STEP10, the developing device 231C, 231M and 231Y of C, M and Y as the detection color are moved to the development position in succession.

Figure 6:
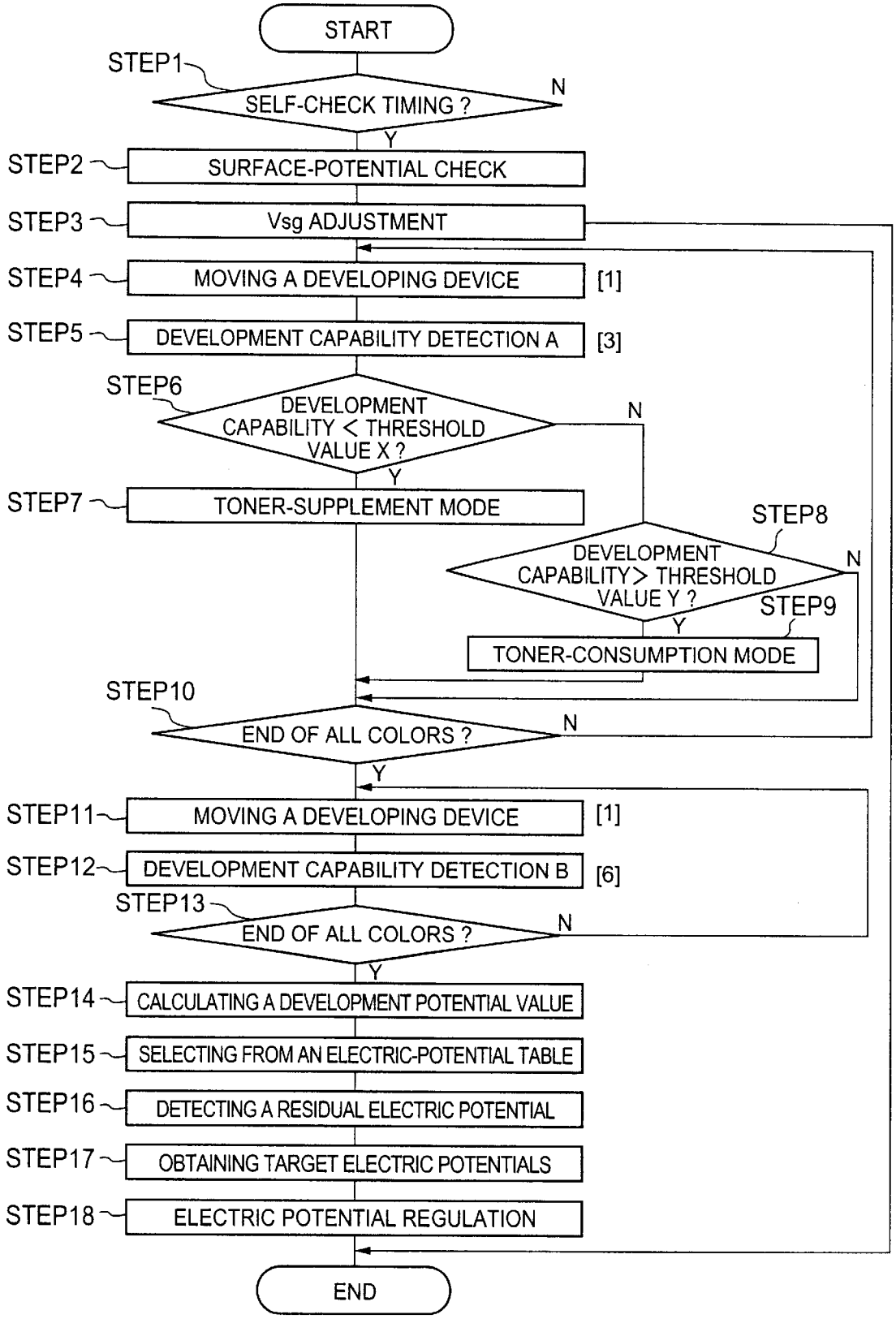
FIG. 6 is a flowchart showing a self-check operation performed in the image-forming device according to the first embodiment of the present invention.
Figure 7:
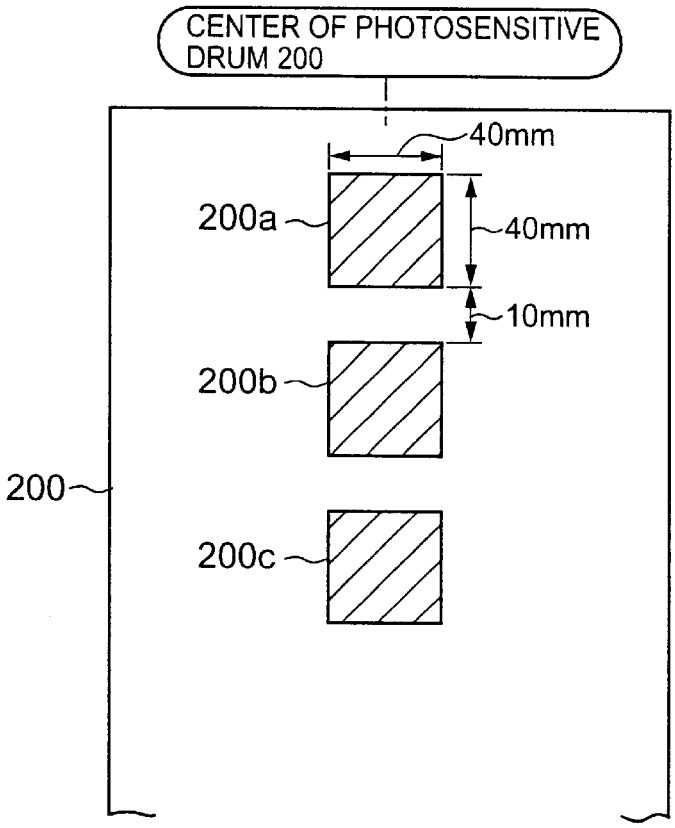
FIG. 7 outlines toner patterns formed in a toner-supplement/consumption regulation performed in the image-forming device according to the first embodiment of the present invention.
Figure 8:
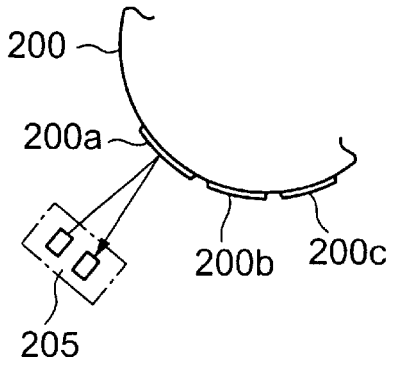
FIG. 8 is an illustration used for explaining an operation of detecting latent image patterns formed on an image-bearing member in the image-forming device according to the first embodiment of the present invention.

In STEP5 (a development capability detection A) in FIG. 6, latent image patterns are formed on the photosensitive drum 200. As shown in FIG. 7 and FIG. 8, electrostatic latent images (three latent image patterns) 200*a*, 200*b* and 200*c* of the maximum write are formed along a revolving direction of the photosensitive drum 200 in a widthwise-center part thereof at predetermined intervals. For example, the three latent image patterns 200*a*, 200*b* and 200*c* are rectangles having each side being 40 mm, and are formed at intervals of 10 mm.

An output value of the surface-potential sensor 204 with respect to an electric potential of each of theses latent image patterns 200*a*, 200*b* and 200*c* is read, and is stored in a RAM (not shown in the figures). After these latent image patterns 200*a*, 200*b* and 20*c* are developed into toner images by the developing device 231K of Bk positioned at the development position, output values of the reflection-density sensor 205 with respect to these toner images are stored in the RAM as Vpi (i=1 to 3). Then, an average development capability (the amount of attached toner) of the solid color is calculated by Vpi/3.

In STEP6 in FIG. 6, when this amount of the attached toner is lower than a threshold value X, it is judged that the development capability of the developing device 231K of the revolver development unit 230 (230 is a developing means as a first processing means) is low. Then, a toner-supplementing motor is turned on for one second and turned off for one second. This cycle is repeated 10 times (the toner-supplement mode: STEP7).

In STEP8, when the amount of the attached toner is (not lower than the threshold value X and even) higher than a threshold value Y, ten images of full-screen halftone solid images of A4 size are formed as internal patterns (formed on the photosensitive drum 200, not printed out on a paper) (the toner-consumption mode STEP9). On the other hand, when the amount of the attached toner is between the threshold values X and Y (i.e., not lower than the threshold value X and not higher than the threshold value Y), STEP10 is performed next, in which it is judged whether or not STEP4 to STEP9 are finished with respect to all of the colors of Bk, C, M and Y. When STEP4 to STEP9 are finished with respect to all of the colors of Bk, C, M and Y, the potential regulation is started from STEP11 as follows.

Figure 9:
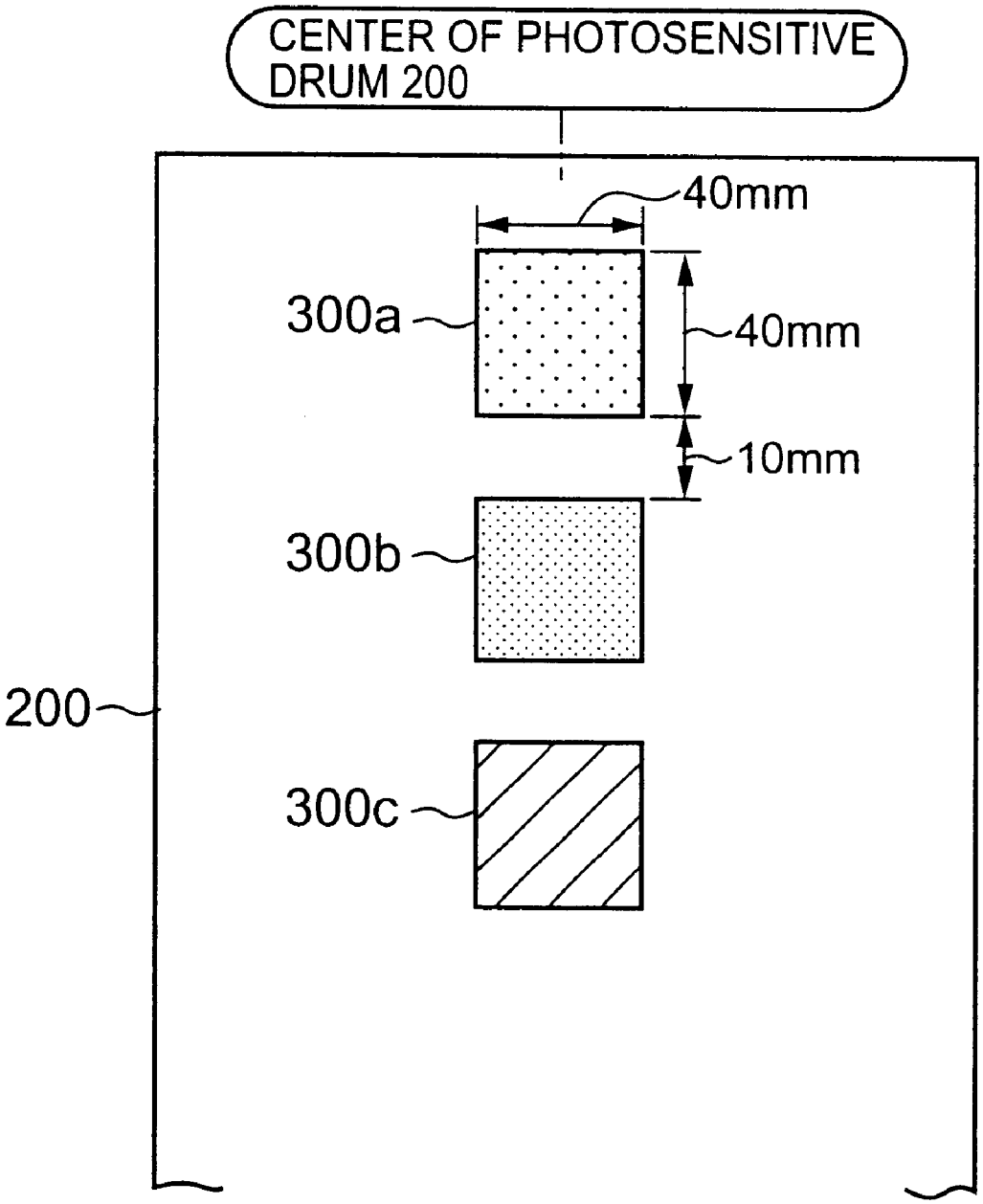
FIG. 9 outlines toner patterns formed in an image-forming-potential regulation performed in the image-forming device according to the first embodiment of the present invention.

In STEP11 in FIG. 6, the developing device of the next development-capability detection color is moved to a predetermined development position so as to form latent image patterns on the photosensitive drum 200. As shown in FIG. 9, the latent image patterns are a number (N) of electrostatic latent images 300*a*, 300*b*, 300*c*, . . . having the number (N) of gradation densities formed along the revolving direction of the photosensitive drum 200 in a widthwise-center part thereof at predetermined intervals. For example, the latent image patterns 300*a*, 300*b*, 300*c*, . . . have ten different gradation densities, and have rectangular shapes formed at intervals of 10 mm, with each side being 40 mm.

An output value of the surface-potential sensor 204 with respect to an electric potential of each of theses latent image patterns 300*a*, 300*b*, 300*c*, is read, and is stored in the RAM (not shown in the figures).

Next, in STEP12 of a P-sensor detection (a development capability detection B) performed by the main regulating unit, these ten latent image patterns 300*a*, 300*b*, 300*c*, . . . are developed, color by color, by the Bk developing device 231K, the C developing device 231C, the M developing device 231M and the Y developing device 231Y into toner images of each color. Then, output values of the reflection-density sensor 205 with respect to these toner images of each color are stored in the RAM as Vpi (i=1 to N), color by color.

It is noted that the main regulating unit electrifies the photosensitive drum 200 uniformly by using the electrifying device 203, varies the output of the semiconductor laser 221 via a laser-optical-system regulation unit (not shown in the figures) so as to form the latent image patterns 300*a*, 300*b*, 300*c*, . . . , and then develops the latent image patterns 300*a*, 300*b*, 300*c*, . . . . However, changing the developing bias potential of each of the developing devices (231K, 231C, 231M and 231Y) can take the place of using the above-mentioned semiconductor laser 221.

Then, in an attached-toner-amount calculating step (included in STEP12) of calculating the amount of attached toner, the main regulating unit converts the output values of the reflection-density sensor 205 stored in the RAM into the amount of attached toner per unit area by referring to a table stored in a ROM (not shown in the figures), and then stores the amount of the attached toner in the RAM.

Figure 10:
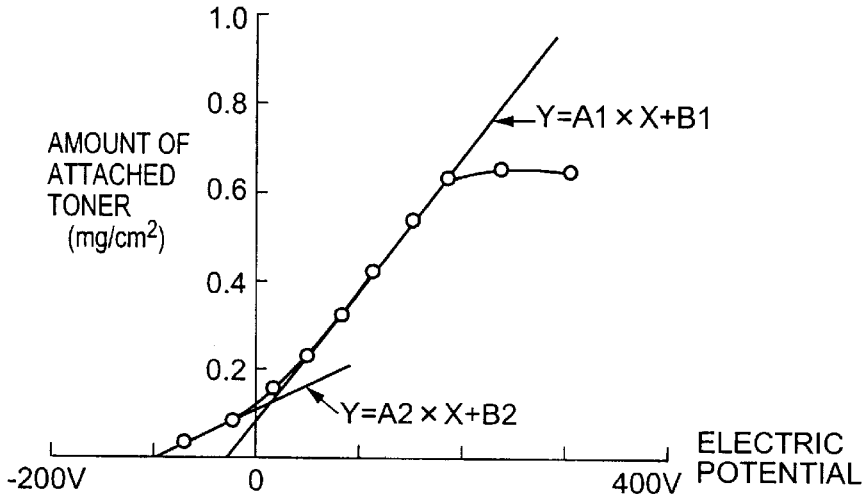
FIG. 10 is a graph showing linear approximation expressions representing results of detecting a development capability of each of developing devices used in the image-forming-potential regulation.

FIG. 10 is a diagram plotting the relation ship between the electric-potential data of the above-mentioned latent image patterns obtained by the reflection-density sensor 205 and the amount of the attached toner obtained in the above-mentioned attached-toner-amount calculating step, in an x-y plane. In FIG. 10, the x-axis indicates the electric potential (the difference between a developing bias potential VB and a surface potential $V_D$ of the photosensitive drum 200: $V_B-V_D$), and the y-axis indicates the amount of attached toner per unit area (mg/cm$^2$).

Generally, regarding an infrared reflection sensor such as the optical reflection-density sensor 205 according to the present embodiment, a part with a large amount of attached toner indicates a saturation characteristic, as shown in FIG. 10, such that a detected electric-potential value does not correspond to the actual amount of attached toner. Therefore, calculating the amount of attached toner by using this electric-potential value detected by the reflection-density sensor 205 with respect to the above-mentioned part with the large amount of attached toner results in a value different from the actual amount of attached toner, and consequently, a toner-supplement regulation based on the amount of attached toner cannot be performed correctly.

Thereupon, for each of the latent image patterns of respective colors, the main regulating unit according to the present embodiment selects only a linear interval of the relationship (the development characteristic γ of the developing device) between the electric potential Xn (n=1 to 10) and the amount of attached toner Yn as the electric potential of the latent image pattern obtained by the surface-potential sensor 204 and the reflection-density sensor 205 (204 and 205 are information-detecting means) and the amount of attached toner after being developed, as described hereinafter. Then, the main regulating unit according to the present embodiment performs a linear approximation with respect to the development characteristic of the developing device by applying the method of least squares to data of the above-mentioned linear interval, as described hereinafter, so as to obtain an approximation linear equation (E) of the development characteristic for each color, and calculate a regulated potential for each color according to the approximation linear equation (E).

The above-mentioned application of the method of least squares is performed by using the following expressions.

$$Xave=\Sigma Xn/k \quad (1)$$

$$Yave=\Sigma Yn/k \quad (2)$$

$$Sx=\Sigma(Xn-Xave)\times(Xn-Xave) \quad (3)$$

$$Sy=\Sigma(Yn-Yave)\times(Yn-Yave) \quad (4)$$

$$Sxy=\Sigma(Xn-Xave)\times(Yn-Yave) \quad (5)$$

Assuming the above-mentioned approximation linear equation (E) is Y=A1×X+B1, the coefficients A1 and B1 are represented as follows by using the above variables.

$$A1=Sxy/Sx \quad (6)$$

$$B1=Yave-A1\times Xave \quad (7)$$

A correlation coefficient R of the approximation linear equation (E) is represented as follows.

$$R\times R=(Sxy\times Sxy)/(Sx\times Sy) \quad (8)$$

The main regulating unit according to the present embodiment samples six sets of five items of data, respectively, from the electric potentials Xn and the amounts of attached toner Yn, i.e., (X1–X5, Y1–Y5), (X2–X6, Y2–Y6), (X3–X7, Y3–Y7), (X4–X8, Y4–Y8), (X5–X9, Y5–Y9) and (X6–X10, Y6–Y10), and then, performs the linear approximations according to the above-mentioned expressions (1) to (8) and calculates the correlation coefficients R so as to obtain the following six sets of approximation linear equations and correlation coefficients (9) to (14).

$$Y11=A11\times X+B11;R11 \quad (9)$$

$$Y12=A12\times X+B12;R12 \quad (10)$$

$$Y13=A13\times X+B13;R13 \quad (11)$$

$$Y14=A14\times X+B14;R14 \quad (12)$$

$$Y15=A15\times X+B15;R15 \quad (13)$$

$$Y16=A16\times X+B16;R16 \quad (14)$$

The main regulating unit selects one of these six approximation linear equations that corresponds to the largest of the correlation coefficients R11 to R16 as the approximation linear equation (E).

When it is judged, in STEP13, that STEP11 and STEP12 are finished with respect to all of the colors, STEP14 is performed next.

Figure 11:
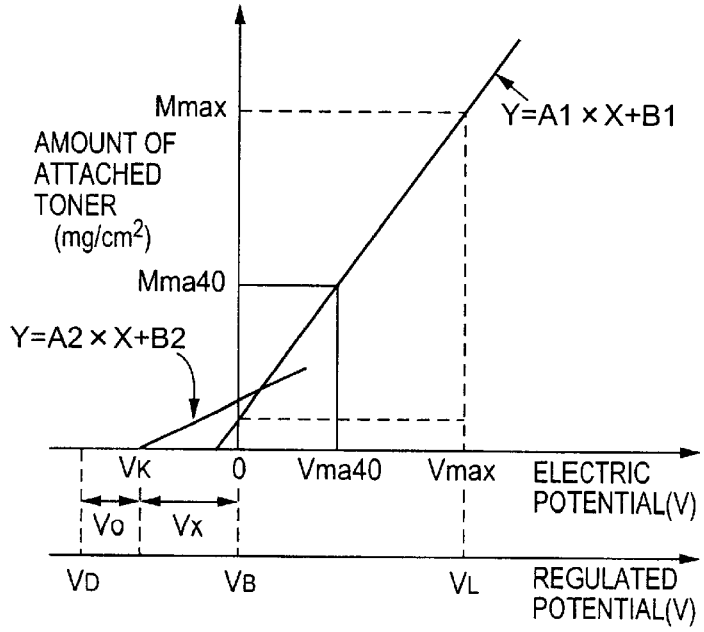
FIG. 11 is a graph showing results of detecting a development capability of each of developing devices used in the image-forming-potential regulation.

In STEP14, according to the approximation linear equation (E) obtained for each color, the main regulating unit calculates a value of X, i.e., a development potential value Vmax when a value of Y becomes a maximum necessary amount of attached toner Mmax, as shown in FIG. 11. The developing bias potential $V_B$ of each of the developing devices (231K, 231C, 231M and 231Y) and a surface potential (an exposure potential) $V_L$ of the image of each color exposed on the photosensitive drum 200 are obtained by the following expressions (15) and (16) transformed from the above-mentioned approximation linear equation (E).

$$V\max=(M\max-B1)/A1 \quad (15)$$

$$V_B-V_{L=V}\max=(M\max-B1)/A1 \quad (16)$$

As above, the relationship between $V_B-V_L$ can be represented by the coefficients A1 and B1 of the approximation linear equation (E).

Accordingly, the expression (16) can be transformed as follows.

$$M\max=A1\times V\max+B1 \quad (17)$$

The relationship between the electrified potential $V_D$ of the photosensitive drum 200 before exposure and the developing bias potential $V_B$ are obtained by an expression (19) below, based on an x-abscissa $V_K$ (a starting voltage of a development of the developing device) at which a straight line of the following linear equation (18) and the x-axis intersect other as shown in FIG. 11 and a surface-stain allowance voltage $V_\alpha$obtained on an experimental basis.

$$Y=A2\times X+B2 \quad (18)$$

$$V_D-V_B=V_K+V_\alpha \quad (19)$$

Therefore, the relationship among Vmax, $V_D$, $V_B$ and $V_L$ are determined according to the expressions (16) and (19). In the present embodiment, the relationship between Vmax and each of the regulated voltages $V_D$, $V_B$ and $V_L$ is obtained through an experiment, etc. by using Vmax as a reference value, and is tabled and stored in the ROM as shown in Table 1 below.

TABLE 1

| No. | Vmax | $V_D$ | $V_B$ | $V_L$ |
|---|---|---|---|---|
| 1 | 160 | 400 | 260 | 110 |
| 2 | 180 | 429 | 286 | 118 |
| 3 | 200 | 457 | 311 | 126 |
| 4 | 220 | 488 | 337 | 133 |
| 5 | 240 | 514 | 363 | 141 |
| 16 | 460 | 829 | 646 | 226 |
| 17 | 480 | 857 | 671 | 234 |
| 18 | 500 | 886 | 697 | 241 |
| 19 | 520 | 914 | 723 | 249 |
| 20 | 540 | 943 | 749 | 257 |

Then, in STEP15 in FIG. 6, the main regulating unit selects an item of Vmax in the Table 1 having the nearest value to Vmax calculated as above for each color, and obtains each of the regulated voltages $V_D$, $V_B$ and $V_L$ corresponding the selected item as a target electric potential.

Subsequently, in STEP16 in FIG. 6, the main regulating unit regulates the semiconductor laser 221 via the laser-optical-system regulation unit so that the laser-emitting power thereof becomes the maximum luminous energy, and the main regulating unit obtains an output value of the surface-potential sensor 204 so as to detect a residual electric potential on the photosensitive drum 200. Then, in STEP17, when the residual electric potential is not zero, the main regulating unit corrects each of the target electric potentials $V_D$, $V_B$ and $V_L$ determined above according to the Table 1 to be adjusted for the residual electric potential so as to obtain corrected target electric potentials.

Finally, in STEP18 in FIG. 6, the main regulating unit adjusts a power-supply circuit so that the charged potential of the photosensitive drum 200 electrified by the electrifying device 203 becomes the target electric potential $V_D$, adjusts the laser-emitting power of the semiconductor laser 221 via the laser-optical-system regulation unit so that the exposure potential of the photosensitive drum 200 becomes the target electric potential $V_L$, and adjusts the power-supply circuit so that the developing bias voltage of each of the developing devices (231K, 231C, 231M and 231Y) becomes the target electric potential $V_B$.

The heretofore-described potential regulation including the toner-supplement mode and the toner-consumption mode is vital for maintaining an image quality at a predetermined level, especially, in a color-copying machine. However, in this potential regulation, the development capability is detected often and the developing devices are moved often for the toner-supplement mode and the toner-consumption mode which normally are not necessary very much. Thus, the self-check takes a long period of time even when the toner-supplement mode and the toner-consumption mode are not necessary.

Thereupon, a description will be given, with reference to FIG. 12, of a self-check performed in the color-copying machine according to a second embodiment of the present invention.

Figure 12:
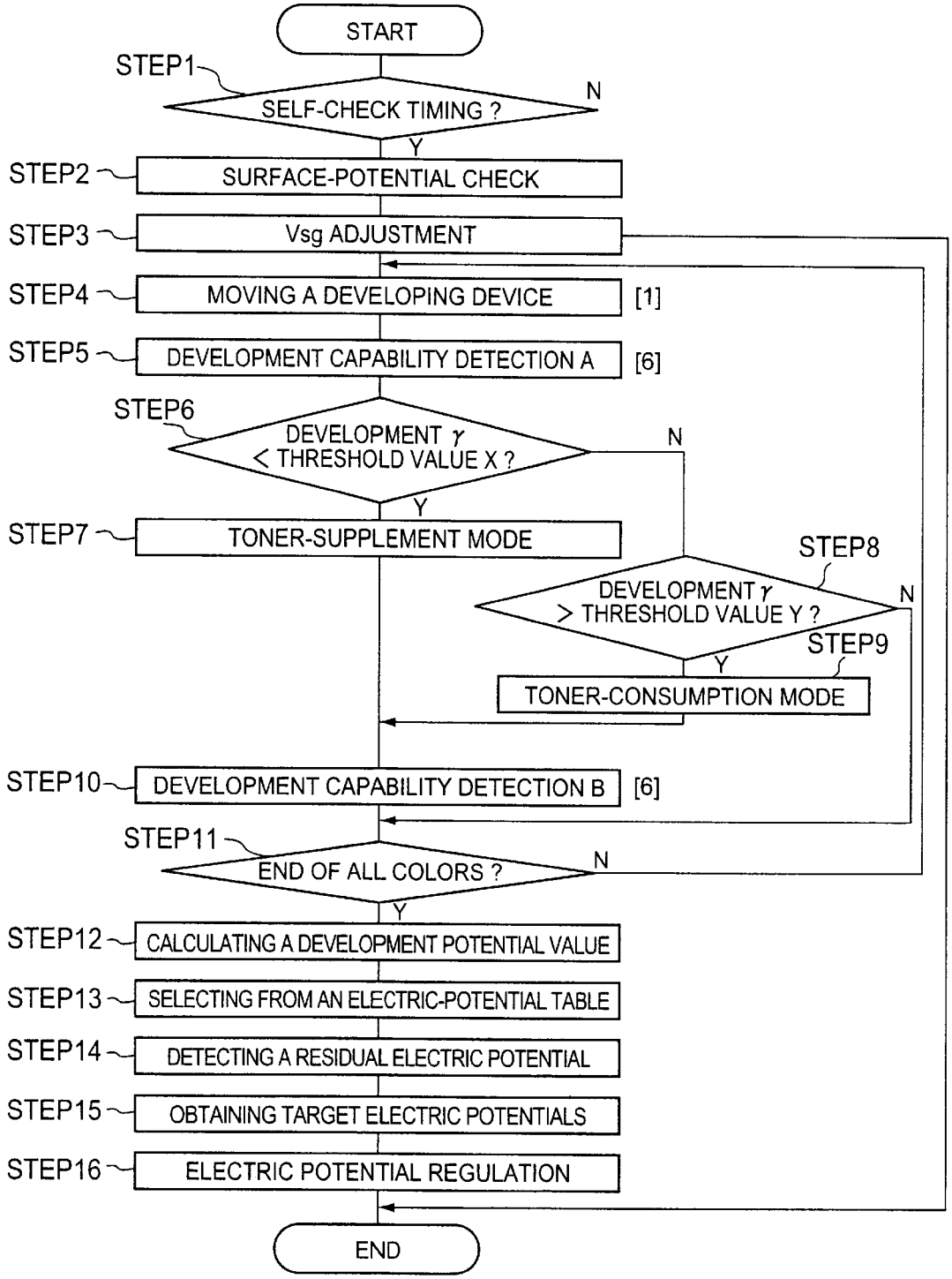
FIG. 12 is a flowchart showing a self-check operation performed in the image-forming device according to a second embodiment of the present invention.

In FIG. 12, STEP1 to STEP4 are the same as in FIG. 6.

In STEP5 (an information-detecting step) in FIG. 12, unlike STEP5 in FIG. 6 using the halftone-solid three latent image patterns 200*a*, 200*b* and 200*c* shown in FIG. 7 and FIG. 8, the gradation latent image patterns 300*a*, 300*b*, 300*c*, . . . as shown in FIG. 9 are formed on the photosensitive drum 200 so as to perform a development capability detection A with respect to each of the developing devices by using the reflection-density sensor 205, as in STEP12 of the development capability detection B shown in FIG. 6 (i.e., as in STEP10 of a development capability detection B shown in FIG. 12).

In STEP6 (a judging step) and STEP8 (a judging step) in FIG. 12, the development γ (i.e., the amount of attached toner based on the electric potential) calculated in STEP5 in FIG. 12 is compared with the threshold values X and Y by a judging means included in the main regulating unit so as to judge which of the toner-supplement mode in the STEP7 (a first processing step) or the toner-consumption mode in STEP9 (a first processing step) is performed next.

As mentioned above, the development capability detection A in STEP5 (a second processing step) in FIG. 12 is equivalent to the development capability detection B in STEP10 (a second processing step) in FIG. 12 performed for the potential regulation. Therefore, when it is judged, in STEP6 and STEP8, that both the toner-supplement mode and the toner-consumption mode do not need to be performed, the detection result of the development capability detection A can be used as the detection result of the development capability detection B (a second regulation mode; a second regulating step). Thereby, the self-check can be performed in a drastically shortened period of time when the toner-supplement mode and the toner-consumption mode are not necessary.

For this purpose, it is necessary that the same image-pattern information can be used in performing the judgments of whether to perform the toner-supplement mode or the toner-consumption mode and in performing the calculations for the potential regulation. Therefore, the present second embodiment utilizes the calculation results of the development γ based on the same image-pattern information.

At this point, the simple amount of attached toner is inevitably influenced by the electric potential. In the present embodiment however, the above-mentioned the development γ is not influenced even when the electric potential varies on the photosensitive drum, which is convenient to perform the series of the above-mentioned modes and regulations.

Accordingly, when it is judged, in the image-forming device (the color-copying machine) according to the present second embodiment, that the toner-density regulation does not need to be performed for a particular developing device of the above-described developing devices, i.e., N in both STEP6 and STEP8 shown in FIG. 12, a first regulation mode (STEP7 or STEP9, and STEP10) is not performed for the particular developing device. In other words, only when it is judged that the toner-density regulation needs to be performed for a particular developing device of the above-described developing devices, i.e., Y in either STEP6 or STEP8 shown in FIG. 12, the above-mentioned first regulation mode is performed for the particular developing device (a first regulating step).

Additionally, according to the image-forming device according to the present embodiment, when it is judged that the toner-density regulation does not need to be performed for the first developing device, for example, among the above-described developing devices, the judgments of whether to perform the toner-density regulation are performed without being erroneously skipped.

Besides, when the development capability detection A is performed by detecting the gradation latent image patterns 300*a*, 300*b*, 300*c*, . . . formed on the photosensitive drum 200, as described above, the gradation latent image patterns 300*a*, 300*b*, 300*c*, . . . do not need to be re-formed to perform the development capability detection B for the potential regulation, in the case of N in both STEP6 and STEP8 shown in FIG. 12. This prevents the toner from being wastefully consumed.

In the image-forming device (the color-copying machine) having the revolver development unit as shown in FIG. 4, in which each of the developing devices is moved to a predetermined position so as to perform a development, it is preferred that the judgments of whether to perform the toner-density regulation with respect to each of the developing devices and the operations of the toner-density regulation with respect to the positively judged developing device are performed in succession, based on at least information A (the amount of attached toner) regarding the toner-density regulation detected by the reflection-density sensor 205 among the information A and information B (the electric potential) regarding at least one (second processing means) of the electrification potential of the electrifying device (electrifying means) 203, the write luminous energy of the semiconductor laser (image-writing means) 221, and the developing bias of each of the developing devices 231K, 231C, 231M and 231Y of the revolver development unit 230 (the developing means).

That is, by successively conducting the judgments of whether to perform the toner-density regulation with respect to each of the developing devices moved to a predetermined development position and the operations of the toner-density regulation with respect to the positively judged developing device, each of the developing devices does not have to be moved between the judgments and the operations. This minimizes a time required for shifting the developing devices to the development position; and thus, the process regulations as described above can be performed in a shorter time.

As described above, the development capability detection B in STEP10 shown in FIG. 12 is performed only to the developing device to which the toner-supplement mode or the toner-consumption mode is performed, and STEP4 (moving the developing device to the development position) to STEP10 (the development capability detection B for the potential regulation) are performed in succession for each color. This shortens a time required for performing the process regulations.

After STEP10 in FIG. 12, when it is judged, in STEP11, that STEP4 to STEP10 are finished with respect to all of the colors, STEP12 is performed next.

In FIG. 12, STEP12 to STEP16 are equivalent to STEP14 to STEP18 shown in FIG. 6.

The following indicates specific time differences in the process regulations between the first embodiment shown in FIG. 6 and the second embodiment shown in FIG. 12. In the following, required times of differing steps are estimated.

Each of the numbers bracketed with [ ] at the right side of STEP4, STEP5, STEP11 and STEP12 in FIG. 6 and STEP4, STEP5 and STEP10 in FIG. 12 represents a time required for performing the individual step.

In the time-differing steps in FIG. 6 and FIG. 12, when the toner-supplement mode or the toner-consumption mode is performed for no color, the second embodiment takes [28], whereas the first embodiment takes [44]. When the toner-supplement mode or the toner-consumption mode is performed for one color, the second embodiment takes [34], whereas the first embodiment takes [44]. When the toner-supplement mode or the toner-consumption mode is performed for two colors, the second embodiment takes [40], whereas the first embodiment takes [44]. When the toner-supplement mode or the toner-consumption mode is performed for three colors, the second embodiment takes [46], whereas the first embodiment takes [44]. When the toner-supplement mode or the toner-consumption mode is performed for four colors, the second embodiment takes [52], whereas the first embodiment takes [44].

As above, when the toner-supplement mode or the toner-consumption mode is not required very much, the second embodiment is effective.

That is, since the toner-supplement mode and the toner-consumption mode are special modes which normally are not necessary in a regulated condition, the image-forming device (the color-copying machine) according to the present embodiment can perform the process regulations in a shortened period of time in most cases. Even if the development capability becomes excessively high or low, the image-forming device (the color-copying machine) according to the present embodiment can perform the toner-supplement mode, the toner-consumption mode and/or the potential regulation so as to correct the excessive development capability, as described above.

The present invention is not limited to the specifically disclosed embodiments, and variations and modifications may be made without departing from the scope of the present invention.

The present application is based on Japanese priority application No. 2000-305553 filed on Oct. 4, 2000, the entire contents of which are hereby incorporated by reference.

What is claimed is:

1. An image-forming device comprising:

information-detecting means for detecting information A regarding first processing means and information B regarding second processing means; and judging means for judging, according to said information A, whether or not a regulation of said first processing means needs to be performed, wherein, when said judging means judges that the regulation of said first processing means needs to be performed, a first regulation mode is performed in which said regulation of said first processing means is performed, said information-detecting means detects at least the information B, and a regulation of said second processing means is performed according to said information B, and when said judging means judges that the regulation of said first processing means does not need to be performed, a second regulation mode is performed in which said first regulation mode is not performed, and the regulation of said second processing means is performed according to said information B.

2. The image-forming device as claimed in claim 1, wherein said information A regards a toner-density regulation regulating a toner density of developing means functioning as said first processing means, and said information B regards at least one of an electrification potential of electrifying means, a write luminous energy of image-writing means, and a developing bias of said developing means, the electrifying means, the image-writing means, and the developing means functioning as said second processing means.

3. The image-forming device as claimed in claim 2, wherein said developing means comprises a plurality of developing devices respectively containing toners of a plurality of colors.

4. An image-forming device comprising:

information-detecting means for detecting information A regarding a toner-density regulation of a plurality of developing devices and information B regarding at least one of an electrification potential of electrifying means, a write luminous energy of image-writing means, and a developing bias of each of said developing devices; and judging means for judging, according to said information A, whether or not the toner-density regulation of each of said developing devices needs to be performed, wherein, when said judging means judges that the toner-density regulation of one of said developing devices needs to be performed, a first regulation mode is performed in which said toner-density regulation of said one of said developing devices is performed, said information-detecting means again detects at least the information B with respect to said one of said developing devices, and a regulation of at least one of said electrification potential of said electrifying means, said write luminous energy of said image-writing means, and said developing bias of said one of said developing devices is performed according to said information B, and when said judging means judges that the toner-density regulation of one of said developing devices does not need to be performed, a second regulation mode is performed in which said first regulation mode is not performed with respect to said one of said developing devices, and the regulation of at least one of said electrification potential of said electrifying means, said write luminous energy of said image-writing means, and said developing bias of said one of said developing devices is performed according to said information B.

5. The image-forming device as claimed in claim 4, wherein each of said developing devices is moved to a predetermined position so as to perform an image-development, and said judging means judges, according to said information A, whether or not the toner-density regulation of each of said developing devices moved to said predetermined position needs to be performed, and successively, when said judging means judges that the toner-density regulation of one of said developing devices moved to said predetermined position needs to be performed, said toner-density regulation of said one of said developing devices is performed.

6. An image-forming method comprising the steps of:

an information-detecting step of detecting information A regarding a first processing step and information B regarding a second processing step;

a judging step of judging, according to said information A, whether or not said first processing step needs to be performed;

a first regulating step of causing said first processing step to be performed, then causing said information-detecting step to detect at least the information B, and causing said second processing step to be performed according to said information B, when said judging step judges that said first processing step needs to be performed; and a second regulating step of causing said second processing step to be performed according to said information B, when said judging step judges that said first processing step does not need to be performed, the second regulating step being performed in place of said first regulating step.

7. The image-forming method as claimed in claim 6, wherein said information A regards a toner-density regulation regulating a toner density of developing means performing said first processing step, and said information B regards at least one of an electrification potential of electrifying means, a write luminous energy of image-writing means, and a developing bias of said developing means, the electrifying means, the image-writing means, and the developing means performing said second processing step.

8. The image-forming method as claimed in claim 7, wherein said developing means comprises a plurality of developing devices respectively containing toners of a plurality of colors.

9. An image-forming method comprising the steps of:

an information-detecting step of detecting information A regarding a toner-density regulation of a plurality of developing devices and information B regarding at least one of an electrification potential of electrifying means, a write luminous energy of image-writing means, and a developing bias of each of said developing devices;

a judging step of judging, according to said information A, whether or not the toner-density regulation of each of said developing devices needs to be performed;

a first regulating step of causing the toner-density regulation of one of said developing devices to be performed, then causing said information-detecting step to again detect at least the information B with respect to said one of said developing devices, and causing a regulation of at least one of said electrification potential of said electrifying means, said write luminous energy of said image-writing means, and said developing bias of said one of said developing devices to be performed according to said information B, when said judging step judges that the toner-density regulation of said one of said developing devices needs to be performed; and a second regulating step of causing the regulation of at least one of said electrification potential of said electrifying means, said write luminous energy of said image-writing means, and said developing bias of one of said developing devices to be performed according to said information B, when said judging step judges that the toner-density regulation of said one of said developing devices does not need to be performed, the second regulating step being performed with respect to said one of said developing devices in place of said first regulating step.

10. The image-forming method as claimed in claim 9, wherein each of said developing devices is moved to a predetermined position so as to perform an image-development, and said judging step judges, according to said information A, whether or not the toner-density regulation of each of said developing devices moved to said predetermined position needs to be performed, and successively, when said judging step judges that the toner-density regulation of one of said developing devices moved to said predetermined position needs to be performed, said first regulating step causes said toner-density regulation of said one of said developing devices to be performed.

* * * * *